US010418708B2

(12) United States Patent
Sudo et al.

(10) Patent No.: US 10,418,708 B2
(45) Date of Patent: Sep. 17, 2019

(54) WIDEBAND ANTENNA

(75) Inventors: Kaoru Sudo, Kyoto-fu (JP); Hirotaka Fujii, Kyoto-fu (JP); Toshiro Hiratsuka, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1512 days.

(21) Appl. No.: 13/555,959

(22) Filed: Jul. 23, 2012

(65) Prior Publication Data

US 2012/0287019 A1 Nov. 15, 2012

Related U.S. Application Data

(63) Continuation of application No. PCT/JP2010/069537, filed on Nov. 3, 2010.

(30) Foreign Application Priority Data

Jan. 27, 2010 (JP) ..... 2010-015562

(51) Int. Cl.
*H01Q 9/04* (2006.01)
*H01Q 5/378* (2015.01)

(52) U.S. Cl.
CPC ..... *H01Q 9/0414* (2013.01); *H01Q 5/378* (2015.01); *H01Q 9/045* (2013.01)

(58) Field of Classification Search
CPC ..... H01Q 9/0414; H01Q 9/0407–0478; H01Q 5/378
See application file for complete search history.

(56) References Cited

U.S. PATENT DOCUMENTS 7,619,568 B2 * 11/2009 Gillette ..... 343/700 MS
8,098,203 B2 1/2012 Ueki
(Continued)

FOREIGN PATENT DOCUMENTS

JP 55-093305 A 7/1980
JP 04-027609 U 3/1992
(Continued)

OTHER PUBLICATIONS

English translation of JP04-027609U.*
(Continued)

*Primary Examiner* — Jessica Han
*Assistant Examiner* — Amal Patel
(74) *Attorney, Agent, or Firm* — Studebaker & Brackett PC

(57) ABSTRACT

This disclosure provides a wideband antenna including a feed line, a ground conductor plate and a radiating conductor element connected to the feed line and facing the ground conductor plate at a distance from the ground conductor plate. A parasitic conductor element is provided on a side opposite to the ground conductor plate as viewed from the radiating conductor plate and is insulated from these plates. A coupling adjusting conductor plate is positioned between the radiating conductor element and the parasitic conductor element, is configured to adjust an amount of coupling between them, overlaps an area where the radiating conductor element and the parasitic conductor element overlap, and straddles the radiating conductor element in a direction orthogonal to the direction of a current I that flows therein. Both end sides of the coupling adjusting conductor plate are electrically connected to the ground conductor plate via via-holes.

9 Claims, 14 Drawing Sheets

(56) References Cited

U.S. PATENT DOCUMENTS

| | | | | |
|---|---|---|---|---|
| 2009/0231207 | A1* | 9/2009 | De Vita | 343/700 MS |
| 2009/0303133 | A1 | 12/2009 | Ueki | |

FOREIGN PATENT DOCUMENTS

| | | | | |
|---|---|---|---|---|
| JP | 2001267833 | A | * | 9/2001 |
| JP | 2003-158419 | A | | 5/2003 |
| JP | 2003-234613 | A | | 8/2003 |
| WO | 2008-072411 | A1 | | 6/2008 |

OTHER PUBLICATIONS

International Search Report; PCT/JP2010/069537; dated Feb. 1, 2011.

Written Opinion of the International Searching Authority, PCT/JP2010/069537, dated Feb. 1, 2011.

The second Office Action issued by the State Intellectual Property Office of People's Republic of China dated Apr. 1, 2014, which corresponds to Chinese Patent Application No. 201080061437.6 and is related to U.S. Appl. No. 13/555,959; with English translation.

The first Office Action issued by the State Intellectual Property Office of People's Republic of China dated Dec. 2, 2013, which corresponds to Chinese Patent Application No. 201080061437.6 and is related to U.S. Appl. No. 13/555,959; with English translation.

The third Office Action issued by the State Intellectual Property Office of People's Republic of China dated Jul. 24, 2014, which corresponds to Chinese Patent Application No. 201080061437.6 and is related to U.S. Appl. No. 13/555,959; with English translation.

* cited by examiner

WIDEBAND ANTENNA

CROSS REFERENCE TO RELATED APPLICATIONS

The present application claims priority to International Application No. PCT/JP2010/069537 filed on Nov. 3, 2010, and to Japanese Patent Application No. 2010-015562 filed on Jan. 27, 2010, the entire contents of each of these applications being incorporated herein by reference in their entirety.

TECHNICAL FIELD

The technical field relates to a wideband antenna suitably used for high frequency signals such as microwave and millimeter wave signals, for example.

BACKGROUND

As an example of wideband antenna according to the related art, a microstrip antenna (patch antenna) is known in which a radiating conductor element and a ground conductor plate are provided facing each other across a dielectric that is thin relative to the wavelength, and a parasitic conductor element is provided on the radiating surface side of the radiating conductor element. See, for example, Japanese Unexamined Patent Application Publication No. 55-93305 (Patent Document 1). The wideband antenna according to Patent Document 1 achieves bandwidth enhancement by exploiting electromagnetic coupling between the radiating conductor element and the parasitic conductor element.

Also, as another example of the related art, a configuration is known in which, in addition to the configuration according to Patent Document 1 mentioned above, two conductor plates that face each other with a gap are placed between the radiating conductor element and the parasitic conductor element, and these conductor plates are electrically connected to the ground conductor plate. See, for example, Japanese Unexamined Utility Model Registration Application Publication No. 4-27609 (Patent Document 2). In the wideband antenna according to Patent Document 2, the conductor plates are placed between the radiating conductor element and the parasitic conductor element. This makes the electromagnetic coupling between the radiating conductor element and the parasitic conductor element stronger, which can lead to increased bandwidth.

SUMMARY

The present disclosure provides a wideband antenna that can achieve increased bandwidth while minimizing variations in characteristics.

According to one aspect of the disclosure, a wideband antenna includes a ground conductor plate configured to be connected to a ground potential, a radiating conductor element facing the ground conductor plate at a distance from the ground conductor plate and connected to a feed line, and a parasitic conductor element on a side opposite to the ground conductor plate as viewed from the radiating conductor element and insulated from the ground conductor plate and the radiating conductor element. A coupling adjusting conductor plate is positioned between the parasitic conductor element and the radiating conductor element, and is configured to adjust an amount of coupling between the parasitic conductor element and the radiating conductor element. The coupling adjusting conductor plate partially overlaps an area where the parasitic conductor element and the radiating conductor element overlap each other, and straddles the radiating conductor element in a direction orthogonal to a direction of a current that flows in the radiating conductor element. The coupling adjusting conductor plate is electrically connected at both end sides to the ground conductor plate.

According to a more specific embodiment, the both end sides of the coupling adjusting conductor plate may be connected to the ground conductor plate by using a columnar conductor.

In another more specific embodiment, the feed line may include a strip line. The strip line may have another ground conductor plate that is provided on a side opposite to the radiating conductor element as viewed from the ground conductor plate, and a strip conductor that is provided between the other ground conductor plate and the ground conductor plate. The strip conductor of the strip line may connect to the radiating conductor element via a connecting aperture that is provided in the ground conductor plate.

In yet another more specific embodiment, the feed line may include a microstrip line. The microstrip line may have a strip conductor that is provided on a side opposite to the radiating conductor element as viewed from the ground conductor plate. The strip conductor of the microstrip line may connect to the radiating conductor element via a connecting aperture that is provided in the ground conductor plate.

In another more specific embodiment according to the present disclosure, the parasitic conductor element may include a substantially rectangular conductor plate that is cut off at a corner portion.

In another more specific embodiment according to the present disclosure, the ground conductor plate, the radiating conductor element, the parasitic conductor element, and the coupling adjusting conductor plate may be provided to a multilayer substrate having a plurality of laminated insulating layers, and may be placed at positions different from each other with respect to a thickness direction of the multilayer substrate.

In still another more specific embodiment a width of the coupling adjusting conductor plate in the orthogonal direction is greater than a width of the radiating conductor element in the orthogonal direction.

In another more specific embodiment, a length of the coupling adjusting conductor plate in the direction of the current is less than the length of the of the radiating conductor element in the direction of the current.

In another more specific embodiment, the length of the coupling adjusting conductor plate is about half the value of the length of the radiating conductor element.

DETAILED DESCRIPTION

Figure 1:
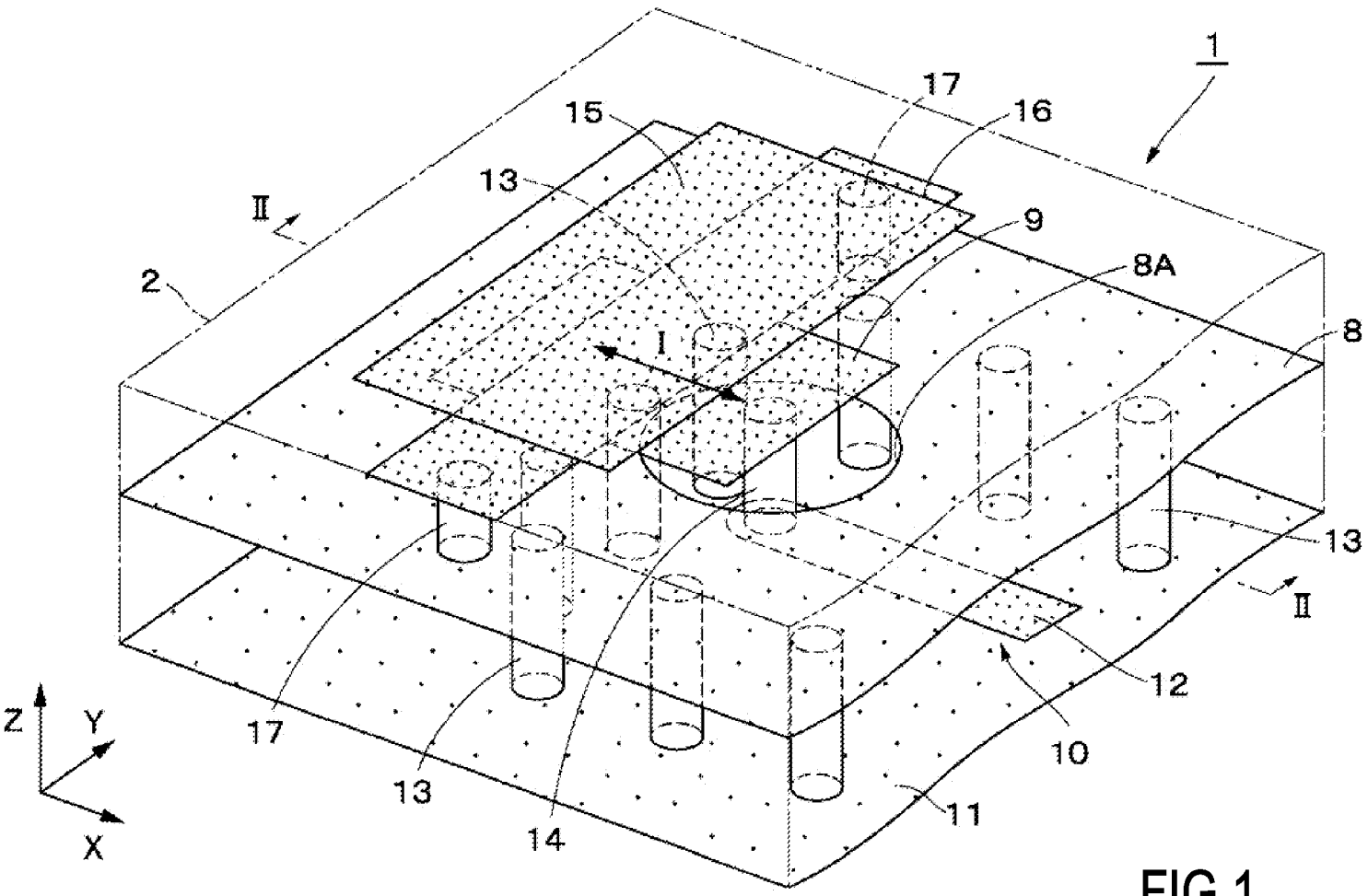
FIG. 1 is a perspective view illustrating a wideband patch antenna according to a first exemplary embodiment.

The inventors realized that in the wideband antenna according to Patent Document 1, the dimension of the distance in the thickness direction between the radiating conductor element and the parasitic conductor element contributes greatly to the magnitude of electromagnetic coupling, and hence there is a limit to bandwidth enhancement.

Additionally, in the wideband antenna according to Patent Document 2, owing to the structure of the conductor plates in which the conductor plates are bent in an L-shape and their ends are attached to the ground conductor plate by soldering, assembly of the conductor plates is difficult, leading to low productivity. In addition, variations in characteristics among individual antennas become significant.

The present disclosure provides a wideband antenna that can achieve increased bandwidth while minimizing variations in characteristics. Hereinafter, as an example of wideband antenna according to an exemplary embodiment, a wideband patch antenna for use in the 60 GHz band is described in detail with reference to the attached drawings.

FIGS. 1 to 4 illustrate a wideband patch antenna 1 according to a first exemplary embodiment. The wideband patch antenna 1 includes a multilayer substrate 2, a ground conductor plate 8, a radiating conductor element 9, a parasitic conductor element 15, a coupling adjusting conductor plate 16, and the like described later.

The multilayer substrate 2 is formed in a flat shape that extends in parallel to, for example, the X-axis direction and the Y-axis direction among the X-axis, Y-axis, and Z-axis directions that are mutually orthogonal. The multilayer substrate 2 has a width dimension of about several mm, for example, with respect to the Y-axis direction that is the width direction, and has a length dimension of about several mm, for example, with respect to the X-axis direction that is the length direction. The multilayer substrate 2 also has a thickness dimension of about several hundred μm, for example, with respect to the Z-axis direction that is the thickness direction.

The multilayer substrate 2 can be formed by, for example, a low temperature co-fired ceramic multilayer substrate (LTCC multilayer substrate). The multilayer substrate 2 has five insulating layers 3 to 7 that are laminated in the Z-axis direction from its front side 2A toward its back side 2B. The insulating layers 3 to 7 are each made of an insulating ceramic material that can be fired at low temperatures of not higher than 1000° C., and formed in a thin layer form.

The ground conductor plate 8 is formed by using, for example, a conductive metallic material such as copper or silver, and is connected to the ground. The ground conductor plate 8 is located between the insulating layer 5 and the insulating layer 6, and covers substantially the entire surface of the multilayer substrate 2. That is, the ground conductor plate 8 covers substantially the entire upper surface of insulating layer 6. The radiating conductor element 9 is provided on the front side with respect to the ground conductor plate 8, and a strip line 10 is provided on the back side with respect to the ground conductor plate 8. Accordingly, in order to provide connection between the radiating conductor element 9 and the strip line 10, for example, a substantially circular connecting aperture 8A is provided in the central portion of the ground conductor plate 8.

The radiating conductor element 9 is formed in a substantially rectangular shape by using a conductive metallic material similar to that of the ground conductor plate 8, for example. The radiating conductor element 9 faces the ground conductor plate 8 at a distance. Specifically, the radiating conductor element 9 is placed between the insulating layer 5 and the insulating layer 4. The insulating layer 5 is placed between the radiating conductor element 9 and the ground conductor plate 8. Therefore, the radiating conductor element 9 faces the ground conductor plate 8 while being insulated from the ground conductor plate 8.

Figure 4:
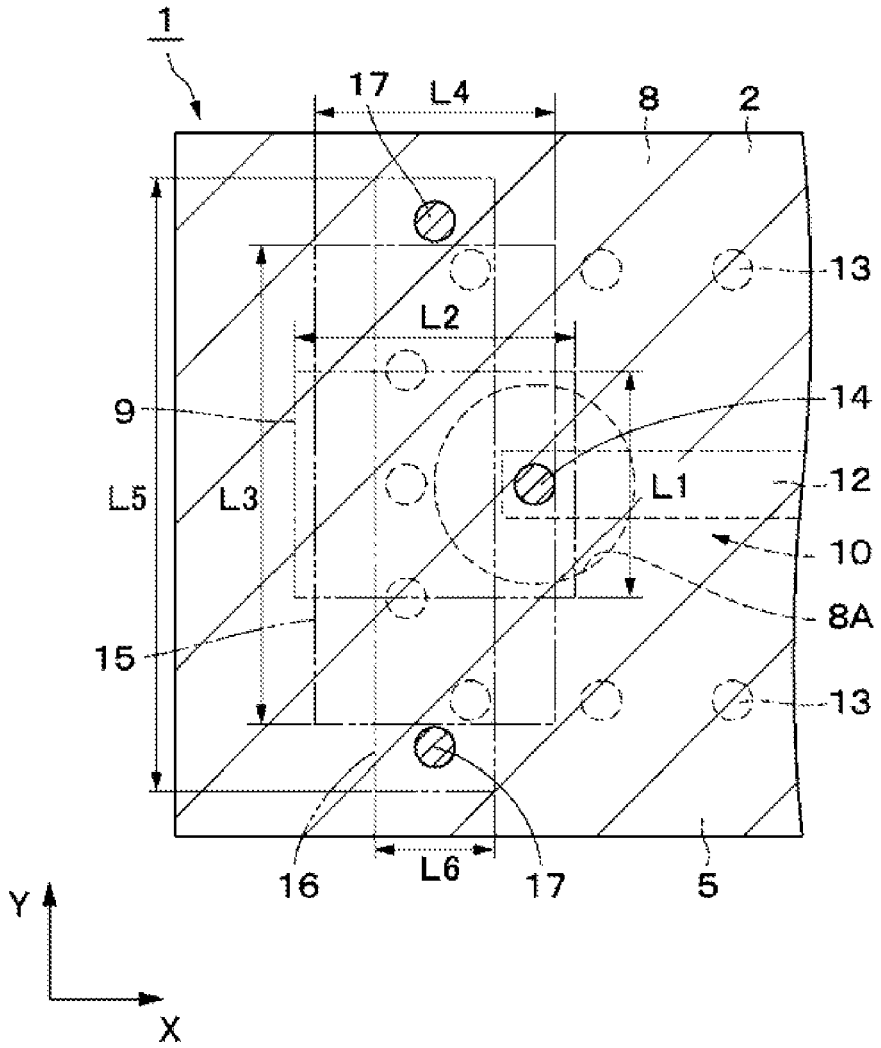
FIG. 4 is a cross-sectional view of the wideband patch antenna taken along the arrow IV-IV in FIG. 2.

As illustrated in FIG. 4, the radiating conductor element 9 has a width dimension L1 of, for example, about several hundred μm in the Y-axis direction, and has a length dimension L2 of, for example, about several hundred μm in the X-axis direction. The length dimension L2 in the X-axis direction of the radiating conductor element 9 is set to a value that is one-half wavelength in electrical length of the high frequency signal used, for example.

Further, a via-hole 14 described later is connected to the radiating conductor element 9 at some point along the X-axis direction. Also, the strip line 10 is connected to the radiating conductor element 9 via the via-hole 14. In the radiating conductor element 9, an electric current I flows in the X-axis direction as electric power is fed from the strip line 10 (see, FIG. 1).

As illustrated in FIGS. 1 to 4, the strip line 10 is provided on the side opposite to the radiating conductor element 9 as viewed from the ground conductor plate 8. The strip line 10 forms a feed line for feeding electric power to the radiating conductor element 9. Specifically, the strip line 10 includes another ground conductor plate 11 and a strip conductor 12. The ground conductor plate 11 is provided on the side opposite to the radiating conductor element 9 as viewed from the ground conductor plate 8. The strip conductor 12 is provided between the ground conductor plate 8 and the ground conductor plate 11. The ground conductor plate 11 is provided on the back side 2B of the multilayer substrate 2 (i.e., on the back side of the insulating layer 7), and covers substantially the entire back side 2B. The ground conductor plate 11 is electrically connected to the ground conductor plate 8 by a plurality of via-holes 13.

The via-holes 13 are each formed as a columnar conductor by providing a through-hole penetrating the insulating layers 6 and 7 and having an inside diameter of about several ten to several hundred μm (e.g., 100 μm) and filling the through-hole with, for example, a conductive metallic material such as copper or silver. The via-holes 13 extend in the Z-axis direction, and are connected to the ground conductor plates 8, 11 at either end. The via-holes 13 are placed so as to surround the strip conductor 12. Thus, the via-holes 13 serve to stabilize the potential of the ground conductor plates 8, 11, and suppress leakage of the high frequency signal that propagates through the strip conductor 12.

The strip conductor 12 can be made of, for example, a conductive metallic material similar to that of the ground conductor plate 8. The strip conductor 12 is formed in the shape of a narrow strip extending in the X-axis direction. The strip conductor 12 is placed between the insulating layer 6 and the insulating layer 7. An end of the strip conductor 12 is placed in the center portion of the connecting aperture 8A, and is connected to the radiating conductor element 9 via the via-hole 14 serving as a connecting line.

The via-hole 14 is formed as a columnar conductor in substantially the same manner as the via-holes 13. The via-hole 14 penetrates the insulating layers 5 and 6, and extends in the Z-axis direction through the center portion of the connecting aperture 8A. The ends of the via-hole 14 are respectively connected to the radiating conductor element 9 and the strip conductor 12. The strip line 10 is formed in line symmetry with respect to a line passing through the center position in the width direction and parallel to the X-axis.

The parasitic conductor element 15 is formed in a substantially rectangular shape by using a conductive metallic material similar to that of the ground conductor plate 8, for example. The parasitic conductor element 15 is located on the side opposite to the ground conductor plate 8 as viewed from the radiating conductor element 9. The parasitic conductor element 15 is placed on the front side 2A of the multilayer substrate 2 (i.e., on the front side of the insulating layer 3). The insulating layers 3 and 4 are placed between the parasitic conductor element 15 and the radiating conductor element 9. Therefore, the parasitic conductor element 15 faces the radiating conductor element 9 at a distance while being insulated from the radiating conductor element 9 and the ground conductor plate 8.

As illustrated in FIG. 4, the parasitic conductor element 15 has a width dimension L3 of, for example, about several hundred μm in the Y-axis direction, and has a length dimension L4 of, for example, about several hundred μm in the X-axis direction. The width dimension L3 of the parasitic conductor element 15 is larger than the width dimension L1 of the radiating conductor element 9, for example. The length dimension L4 of the parasitic conductor element 15 is smaller than the length dimension L2 of the radiating conductor element 9, for example. The relative sizes and specific shapes of the parasitic conductor element 15 and the radiating conductor element 9 are not limited to those mentioned above but are set as appropriate by taking factors such as the radiation pattern of the wideband patch antenna 1 into consideration. The parasitic conductor element 15 produces electromagnetic coupling with the radiating conductor element 9.

Figure 2:
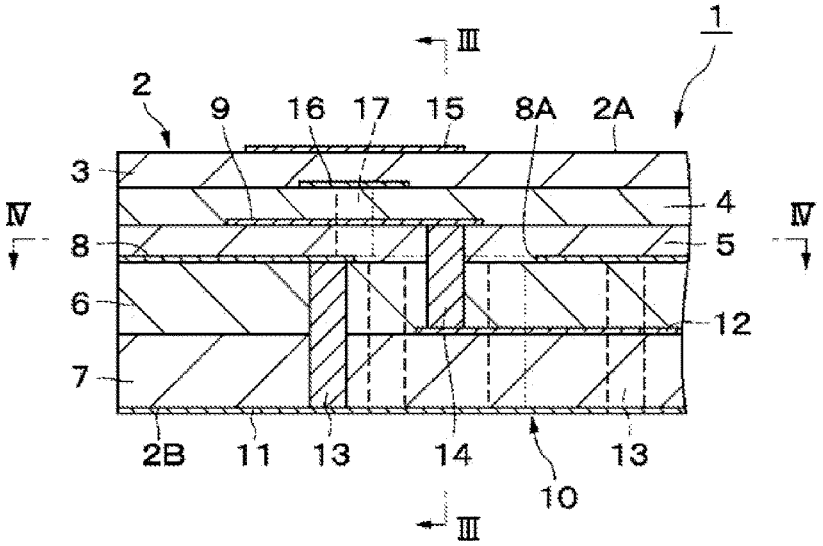
FIG. 2 is a cross-sectional view of the wideband patch antenna taken along the arrow II-II in FIG. 1.
Figure 3:
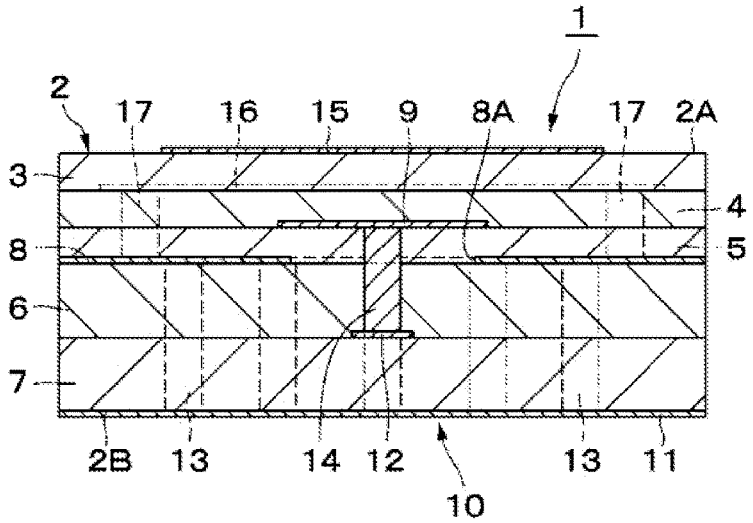
FIG. 3 is a cross-sectional view of the wideband patch antenna taken along the arrow III-III in FIG. 2.

The coupling adjusting conductor plate 16 is formed in a substantially rectangular shape by using a conductive metallic material similar to that of the ground conductor plate 8, for example. The coupling adjusting conductor plate 16 is placed between the radiating conductor element 9 and the parasitic conductor element 15. Specifically, as illustrated in FIGS. 2 and 3, the coupling adjusting conductor plate 16 is placed between the insulating layer 3 and the insulating layer 4, and is insulated from the radiating conductor element 9 and the parasitic conductor element 15.

As illustrated in FIG. 4, the coupling adjusting conductor plate 16 has a width dimension L5 of, for example, about several hundred μm in the Y-axis direction, and has a length dimension L6 of, for example, about several hundred μm in the X-axis direction. The width dimension L5 of the coupling adjusting conductor plate 16 is, for example, larger than the width dimension L1 of the radiating conductor element 9 and the width dimension L3 of the parasitic conductor element 15. The length dimension L6 of the coupling adjusting conductor plate 16 is, for example, smaller than the length dimension L2 of the radiating conductor element 9 and the length dimension L4 of the parasitic conductor element 15. Thus, the coupling adjusting conductor plate 16 crosses and covers a center portion (for example, a center portion in the X-axis direction) that is a part of the area where the radiating conductor element 9 and the parasitic conductor element 15 overlap each other, in the Y-axis direction. Therefore, the coupling adjusting conductor plate 16 straddles the radiating conductor element 9 in a direction orthogonal to the direction of the current I that flows in the radiating conductor element 9.

A pair of via-holes 17 are provided at both end sides of the coupling adjusting conductor plate 16. The via-holes 17 are each formed as a columnar conductor in substantially the same manner as the via-holes 13. The via-holes 17 penetrate the insulating layers 4 and 5, and electrically connect the coupling adjusting conductor plate 16 and the ground conductor plate 8 to each other.

The radiating conductor element 9, the parasitic conductor element 15, and the coupling adjusting conductor plate 16 can be provided in such a way that, for example, their center positions are located at the same position in the XY-plane. Also, the radiating conductor element 9, the parasitic conductor element 15, and the coupling adjusting conductor plate 16 can be formed in line symmetry with respect to a line passing through their center positions and parallel to the X-axis, and can be formed in line symmetry with respect to a line passing through their center positions and parallel to the Y-axis. The coupling adjusting conductor plate 16 adjusts the amount of coupling between the radiating conductor element 9 and the parasitic conductor element 15.

The wideband patch antenna 1 according to this embodiment is configured as mentioned above. Next, the operation of the wideband patch antenna 1 is described.

First, when electric power is fed from the strip line 10 toward the radiating conductor element 9, the current I flows in the radiating conductor element 9 along the X-axis direction. Thus, the wideband patch antenna 1 transmits or receives a high frequency signal according to the length dimension L2 of the radiating conductor element 9.

Figure 5:
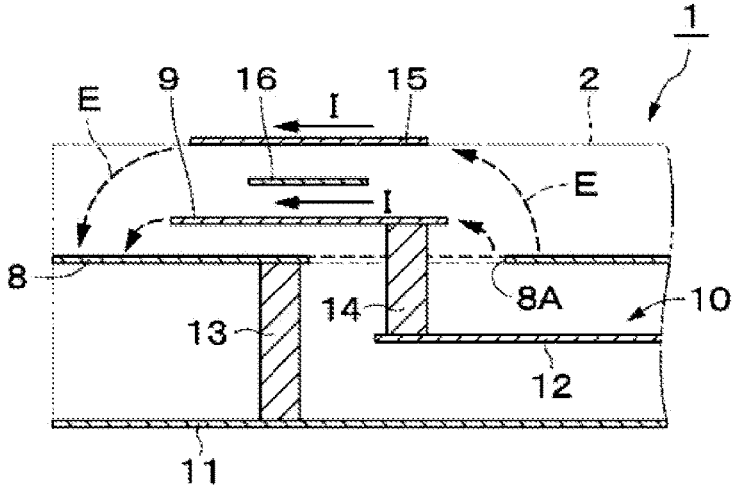
FIG. 5 is an explanatory drawing illustrating the first resonant mode of the wideband patch antenna at the same position as FIG. 2.
Figure 6:
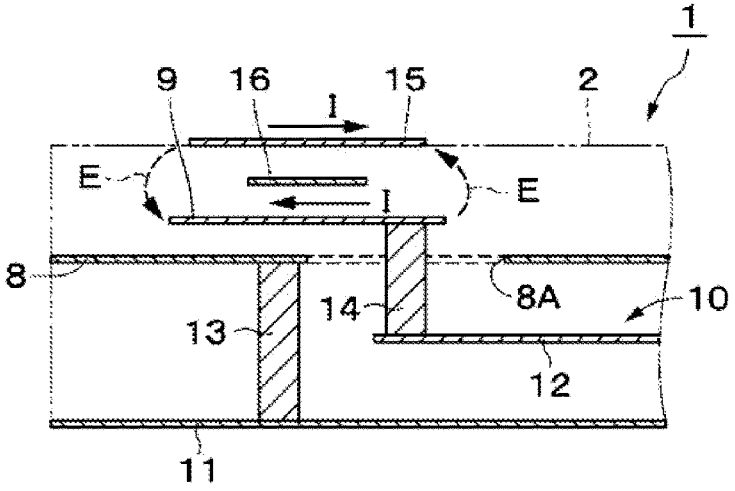
FIG. 6 is an explanatory drawing illustrating the second resonant mode of the wideband patch antenna at the same position as FIG. 2.

At this time, the radiating conductor element 9 and the parasitic conductor element 15 are electromagnetically coupled to each other and, as illustrated in FIGS. 5 and 6, have two resonant modes with different resonant frequencies. The return loss of high frequency signals decreases at these two resonant frequencies. In addition, the return loss of high frequency signals decreases also in the frequency range between these two resonant frequencies. Therefore, the usable frequency range for high frequency signals increases as compared with a case where the parasitic conductor element 15 is omitted.

As the distance dimension between the parasitic conductor element 15 and the radiating conductor element 9 becomes larger, the frequency range over which the strip line 10 and the radiating conductor element 9 are matched tends to increase. However, as the distance dimension between the parasitic conductor element 15 and the radiating conductor element 9 becomes larger, the overall size of the resulting antenna increases, which makes application of such an antenna to miniature electronic devices difficult.

In contrast, according to this embodiment, the coupling adjusting conductor plate 16 is provided between the radiating conductor element 9 and the parasitic conductor element 15. Therefore, the amount of coupling between the radiating conductor element 9 and the parasitic conductor element 15 can be adjusted by using the coupling adjusting conductor plate 16.

Figure 7:
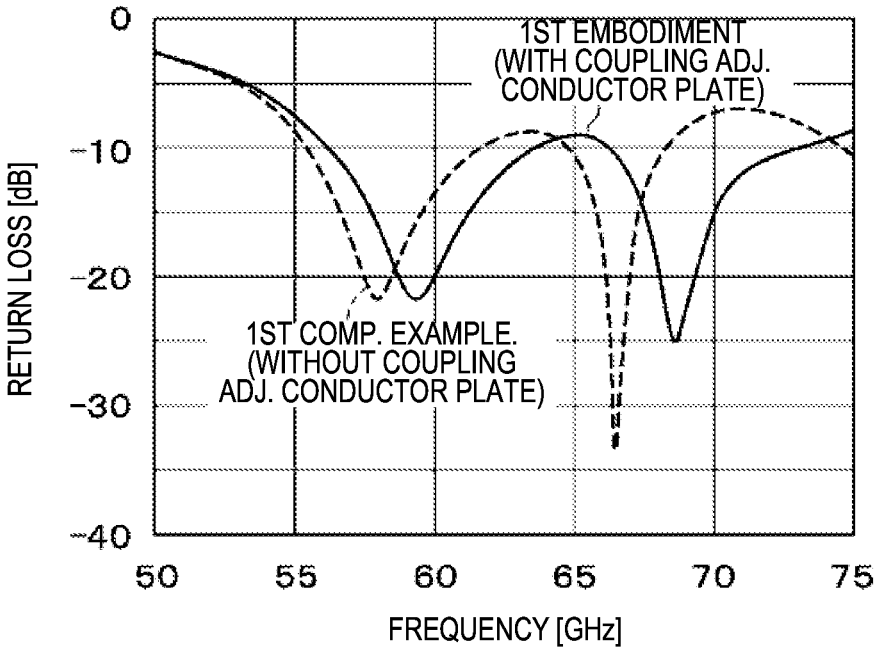
FIG. 7 is a characteristic diagram illustrating the frequency characteristics of return loss, for each of the first embodiment and a first comparative example.

To investigate the effect of the coupling adjusting conductor plate 16, the frequency characteristics of return loss were measured for a case where the coupling adjusting conductor plate 16 is provided as in the first (1st) embodiment, and a first comparative (1st comp.) example case where the coupling adjusting conductor plate 16 is omitted. The results are illustrated in FIG. 7. The thickness dimension of the multilayer substrate 2 was set to 0.7 mm. The width dimension L1 of the radiating conductor element 9 was set to 0.55 mm, and its length dimension L2 was set to 0.7 mm. The width dimension L3 of the parasitic conductor element 15 was set to 1.15 mm, and its length dimension L4 was set to 0.6 mm. The width dimension L5 of the coupling adjusting conductor plate 16 was set to 1.5 mm, and its length dimension L6 was set to 0.3 mm. The diameter of the via-holes 13, 14, and 17 was set to 0.1 mm.

The results in FIG. 7 show that in the case where the coupling adjusting conductor plate 16 is not provided, i.e., as shown by the curve labeled "1ST COMP. EXAMPLE (WITHOUT COUPLING ADJ. CONDUCTOR PLATE)," the frequency bandwidth over which the return loss is below −8 dB is about 14 GHz. In contrast, in the case where the coupling adjusting conductor plate 16 is provided i.e., as shown by the curve labeled "1ST EMBODIMENT (WITH COUPLING ADJ. CONDUCTOR PLATE)," the frequency bandwidth over which the return loss is below −8 dB is about 19 GHz, indicating an increase in the corresponding bandwidth.

In this way, the coupling adjusting conductor plate 16 can adjust the resonant frequency of current in accordance with its width dimension L5, and can adjust the strength of electromagnetic coupling between the radiating conductor element 9 and the parasitic conductor element 15 in accordance with its length dimension L6.

Figure 8:
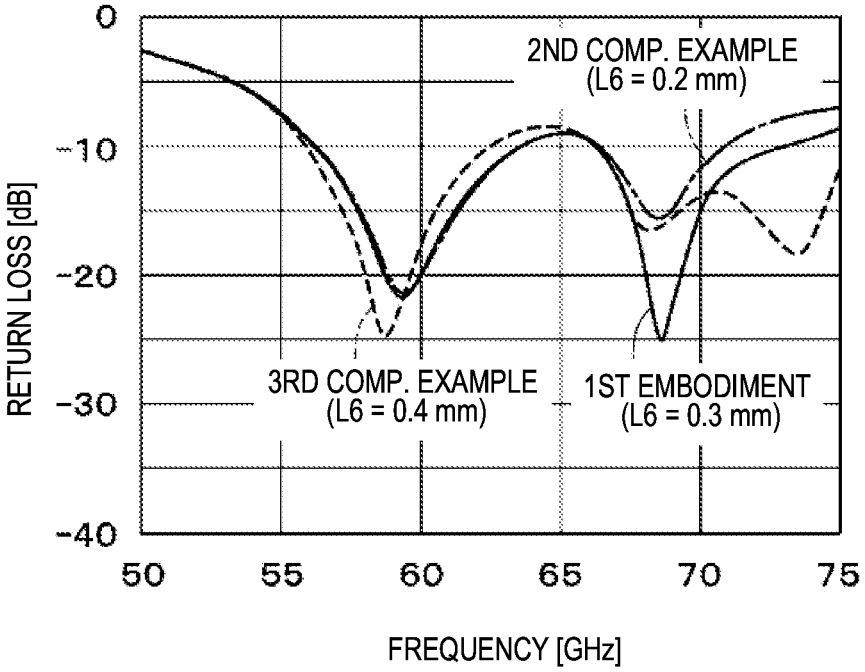
FIG. 8 is a characteristic diagram illustrating the frequency characteristics of return loss, for each of the first embodiment and second and third comparative examples.

An optimum value exists for the length dimension L6 of the coupling adjusting conductor plate 16. For example, as illustrated as a second comparative (2ND COMP.) example in FIG. 8, setting a small value (L6=0.2 mm) as the length dimension of the coupling adjusting conductor plate 16 can sometimes lead to smaller return loss on the high frequency side and hence narrower bandwidth. On the other hand, as illustrated as a third comparative (3RD COMP.) example in FIG. 8, setting an excessively large value (L6=0.6 mm) as the length dimension of the coupling adjusting conductor plate 16 can sometimes cause the return loss to rise in the frequency range between the two resonant frequencies, resulting in narrower bandwidth. For this reason, the length dimension L6 of the coupling adjusting conductor plate 16 is preferably set to, for example, about half the value of the length dimension L2 of the radiating conductor element 9.

In this way, according to this embodiment, the coupling adjusting conductor plate 16 partially covers, or overlaps the area where the radiating conductor element 9 and the parasitic conductor element 15 overlap each other, and straddles the radiating conductor element 9 in a direction orthogonal to the direction of the current I that flows in the radiating conductor element 9. Therefore, when the radiating conductor element 9 and the parasitic conductor element 15 are electromagnetically coupled to each other, the strength of the electromagnetic coupling can be adjusted by using the coupling adjusting conductor plate 16, thereby increasing the frequency range over which matching is obtained between the strip line 10 and the radiating conductor element 9.

Since the ground conductor plate 8 and the coupling adjusting conductor plate 16 are provided to the multilayer substrate 2, the both end sides of the coupling adjusting conductor plate 16 can be easily connected to the ground conductor plate 8 by using the via-holes 17 that penetrate the insulating layers 4 and 5 of the multilayer substrate 2. Therefore, the potential of the coupling adjusting conductor plate 16 can be stabilized, and also the electrical characteristics of the coupling adjusting conductor plate 16 can be made symmetrical with respect to the Y-axis direction, thereby suppressing occurrence of stray capacitance, unwanted resonance phenomenon, and so on as compared with a case where only one end side of the coupling adjusting conductor plate 16 is connected to the ground conductor plate 8.

The ground conductor plate 8, the radiating conductor element 9, the parasitic conductor element 15, and the coupling adjusting conductor plate 16 are provided to the multilayer substrate 2 having the plurality of laminated insulating layers 3 to 7. Therefore, by providing the parasitic conductor element 15, the coupling adjusting conductor plate 16, the radiating conductor element 9, and the ground conductor plate 8 in order on the front sides of the different insulating layers 3 to 7, respectively, these components can be easily placed at different positions with respect to the thickness direction of the multilayer substrate 2.

Further, the strip line 10 is located on the side opposite to the radiating conductor element 9 as viewed from the ground conductor plate 8. Therefore, the strip line 10 can be formed together with the ground conductor plate 8, the radiating conductor element 9, the parasitic conductor element 15, and the coupling adjusting conductor plate 16, in the multilayer substrate 2 provided with these components, thereby improving productivity and reducing variations in characteristics.

Next, FIGS. 9 to 12 illustrate a second exemplary embodiment. The characteristic feature of this embodiment resides in that a microstrip line is connected to the radiating conductor element. In this embodiment, components that are identical to those of the first exemplary embodiment mentioned above are denoted by the identical symbols and are described above.

A wideband patch antenna 21 according to the second exemplary embodiment includes a multilayer substrate 22, the ground conductor plate 8, the radiating conductor element 9, the parasitic conductor element 15, the coupling adjusting conductor plate 16, and the like. In substantially the same manner as the multilayer substrate 2 according to the first exemplary embodiment, the multilayer substrate 22 can be formed by an LTCC multilayer substrate, for example, and has four insulating layers 23 to 26 that are laminated in the Z-axis direction from its front side 22A toward its back side 22B.

In this case, the ground conductor plate 8 is provided between the insulating layer 25 and the insulating layer 26, and covers substantially the entire surface of the multilayer substrate 22. That is, the ground conductor plate 8 covers substantially the entire upper surface of insulating layer 26. The radiating conductor element 9 is located between the insulating layer 24 and the insulating layer 25, and faces the ground conductor plate 8 at a distance. The parasitic conductor element 15 is provided on the front side 22A of the multilayer substrate 22 (i.e., on the front side of the insulating layer 23). The parasitic conductor element 15 is located on the side opposite to the ground conductor plate 8 as viewed from the radiating conductor element 9, and is insulated from the radiating conductor element 9 and the ground conductor plate 8.

The coupling adjusting conductor plate 16 is provided between the insulating layer 23 and the insulating layer 24, and is placed between the radiating conductor element 9 and the parasitic conductor element 15. The coupling adjusting conductor plate 16 partially covers (i.e., overlaps when viewed in the thickness direction) the area where the radiating conductor element 9 and the parasitic conductor element 15 overlap each other, and straddles the radiating conductor element 9 in the Y-axis direction. The both end sides of the coupling adjusting conductor plate 16 are electrically connected to the ground conductor plate 8 via the via-holes 17.

Figure 9:
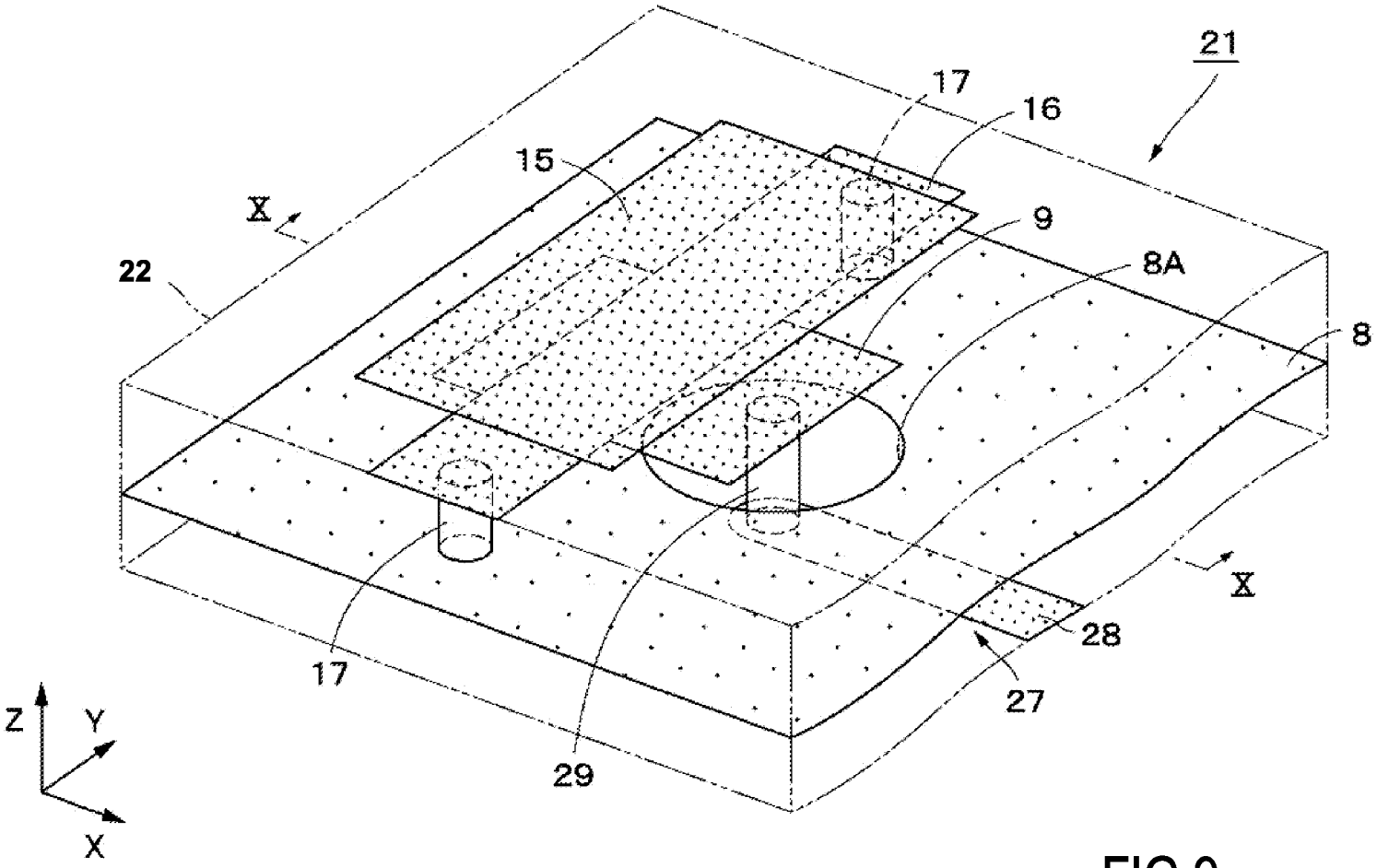
FIG. 9 is a perspective view illustrating a wideband patch antenna according to a second exemplary embodiment.
Figure 10:
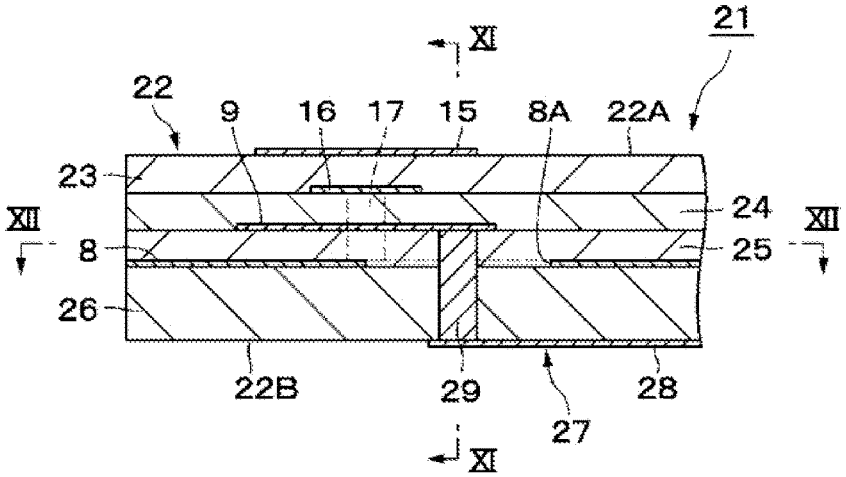
FIG. 10 is a cross-sectional view of the wideband patch antenna taken along the arrow X-X in FIG. 9.
Figure 11:
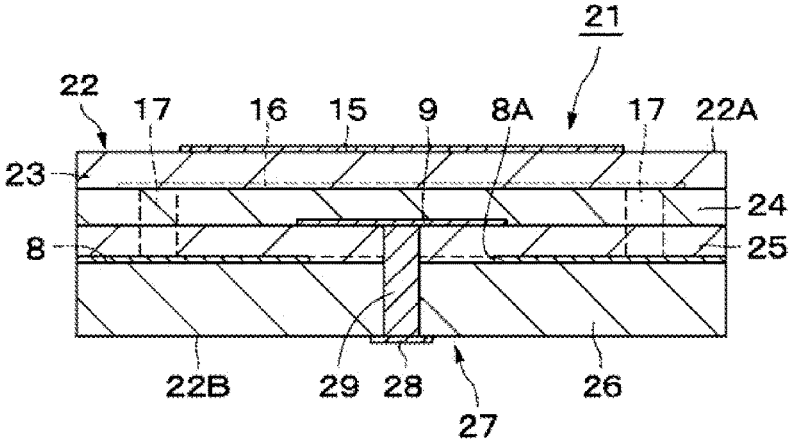
FIG. 11 is a cross-sectional view of the wideband patch antenna taken along the arrow XI-XI in FIG. 10.
Figure 12:
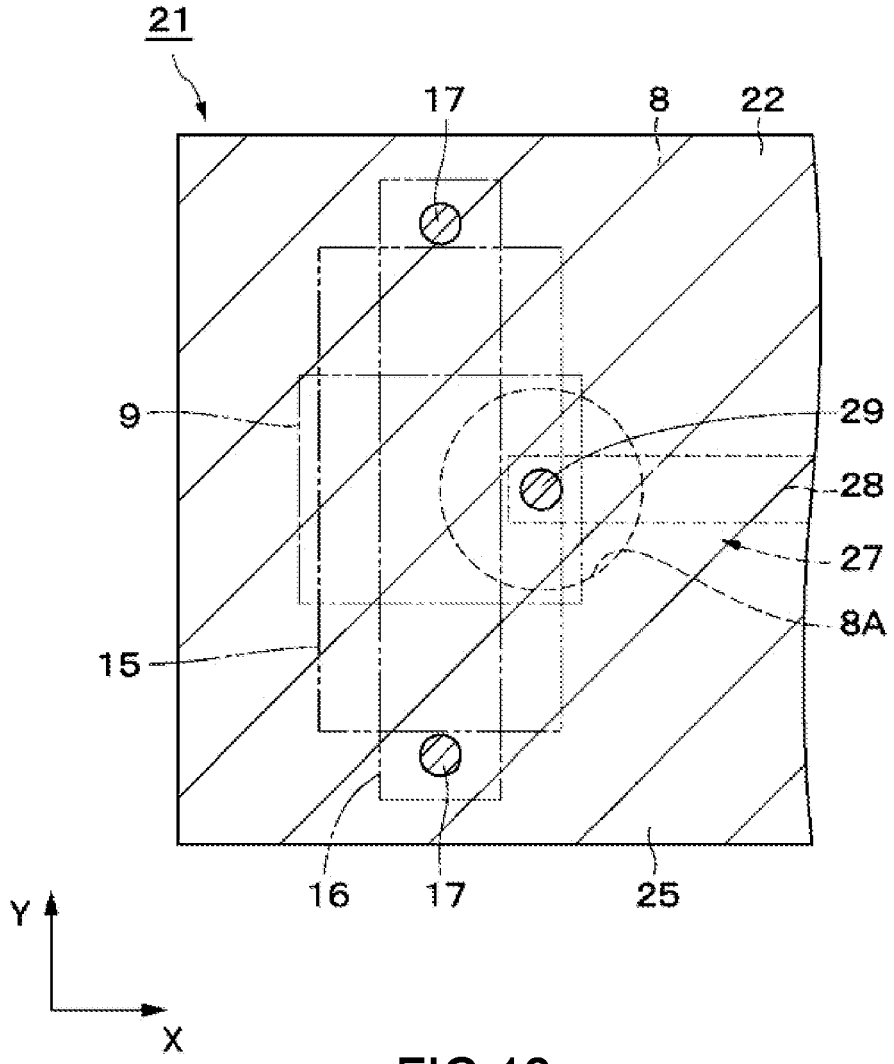
FIG. 12 is a cross-sectional view of the wideband patch antenna taken along the arrow XII-XII in FIG. 10.

As illustrated in FIGS. 9 to 11, a microstrip line 27 is provided on the side opposite to the radiating conductor element 9 as viewed from the ground conductor plate 8. The microstrip line 27 forms a feed line for feeding electric power to the radiating conductor element 9. Specifically, the microstrip line 27 includes a strip conductor 28 that is provided on the side opposite to the radiating conductor element 9 as viewed from the ground conductor plate 8. The strip conductor 28 can be made of a conductive metallic material similar to that of the ground conductor plate 8, for example, and is formed in the shape of a narrow strip extending in the X-axis direction. The strip conductor 28 is provided on the back side 22B of the multilayer substrate 22 (the back side of the insulating layer 26). The microstrip line 27 is formed in line symmetry with respect to a line passing through the center position in the width direction and parallel to the X-axis.

An end of the strip conductor 28 is placed in the center portion of the connecting aperture 8A, and is connected to the radiating conductor element 9 via a via-hole 29 serving as a connecting line. The via-hole 29 is formed in substantially the same manner as the via-hole 14 according to the first exemplary embodiment. The via-hole 29 penetrates the insulating layers 25 and 26, and extends in the Z-axis direction through the center portion of the connecting aperture 8A. The ends of the via-hole 29 are respectively connected to the radiating conductor element 9 and the strip conductor 28.

In this way, in this embodiment as well, an operational effect similar to that of the first exemplary embodiment can be obtained. In particular, in this embodiment, the microstrip line 27 is connected to the radiating conductor element 9. Therefore, as compared with the strip line 10 according to the first exemplary embodiment, the configuration of the microstrip line 27 can be simplified, thereby reducing manufacturing cost.

Figure 13:
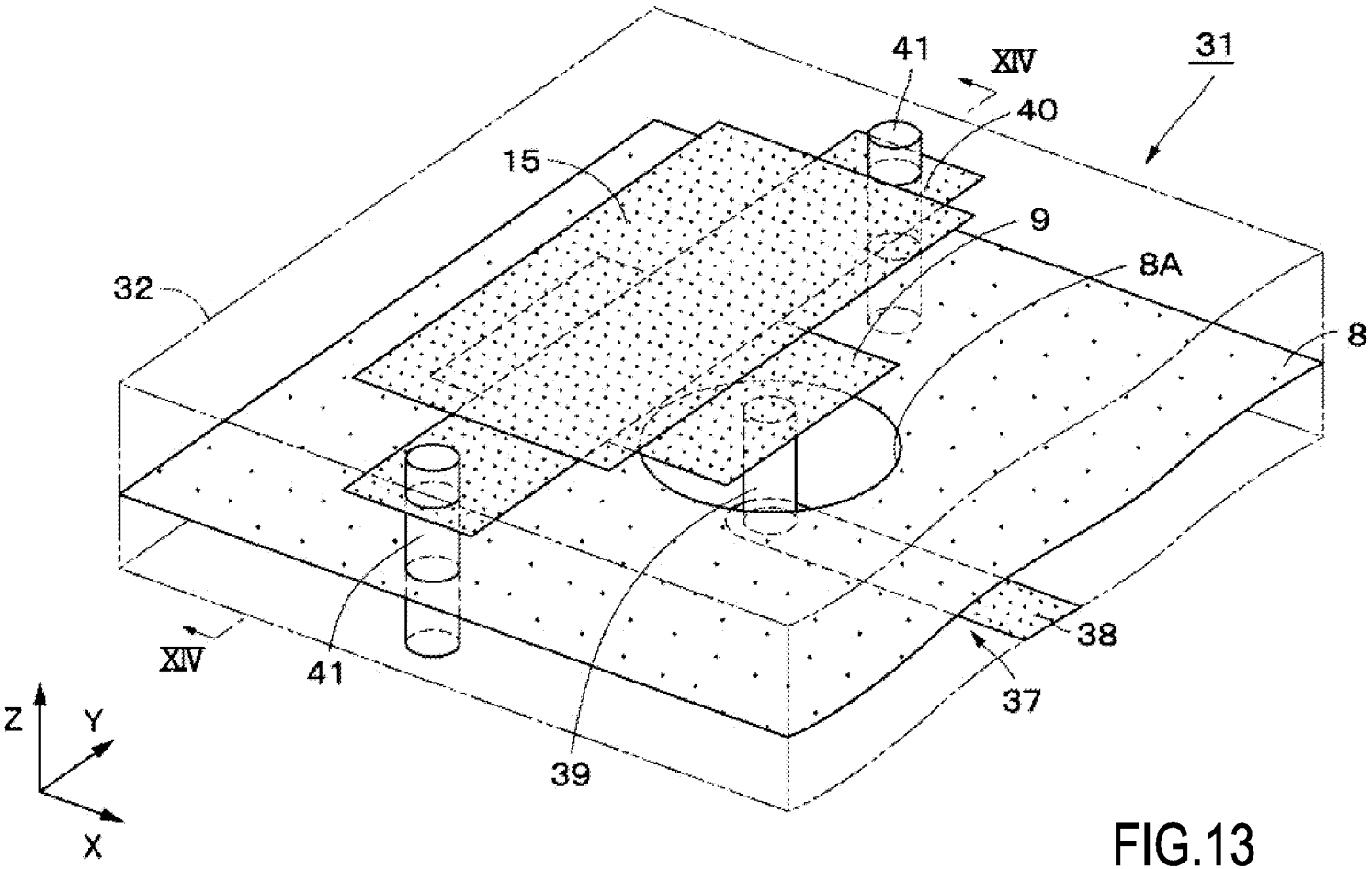
FIG. 13 is a perspective view illustrating a wideband patch antenna according to a third exemplary embodiment.
Figure 14:
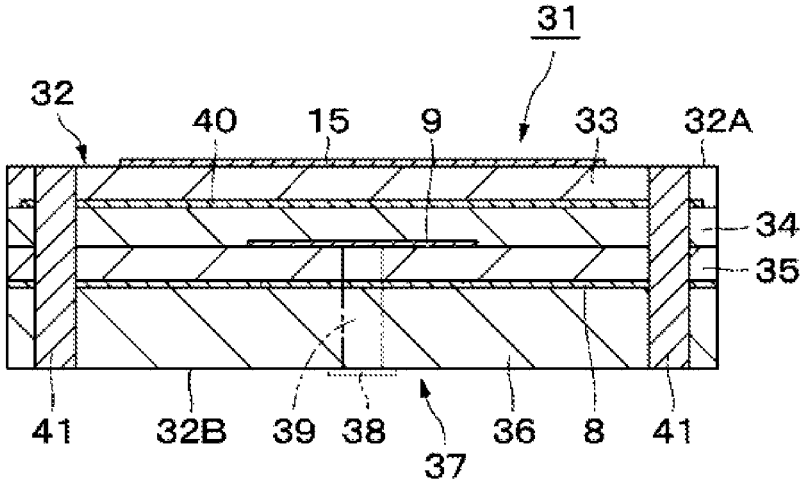
FIG. 14 is a cross-sectional view of the wideband patch antenna taken along the arrow XIV-XIV in FIG. 13.

Next, FIGS. 13 and 14 illustrate a third exemplary embodiment. The characteristic feature of this embodiment resides in that the coupling adjusting conductor plate is connected to the ground conductor plate by using via-holes that penetrate the multilayer substrate. In this embodiment, components that are identical to those of the first exemplary embodiment mentioned above are denoted by the identical symbols and are described above.

A wideband patch antenna 31 according to the third exemplary embodiment includes a multilayer substrate 32, the ground conductor plate 8, the radiating conductor element 9, the parasitic conductor element 15, a coupling adjusting conductor plate 40, and the like. The multilayer substrate 32 is formed in substantially the same manner as the multilayer substrate 22 according to the second exemplary embodiment. The multilayer substrate 32 has four insulating layers 33 to 36 that are laminated in the Z-axis direction from its front side 32A toward its back side 32B.

In this case, the ground conductor plate 8 is provided between the insulating layer 35 and the insulating layer 36, and covers substantially the entire surface of the multilayer substrate 32. That is, the ground conductor plate 8 covers substantially the entire upper surface of insulating layer 36. The radiating conductor element 9 is located between the insulating layer 34 and the insulating layer 35, and faces the ground conductor plate 8 at a distance. The parasitic conductor element 15 is provided on the front side 32A of the multilayer substrate 32 (i.e., on the front side of the insulating layer 33). The parasitic conductor element 15 is located on the side opposite to the ground conductor plate 8 as viewed from the radiating conductor element 9, and is insulated from the radiating conductor element 9 and the ground conductor plate 8.

The microstrip line 37 is formed in substantially the same manner as the microstrip line 27 according to the second exemplary embodiment. The microstrip line 37 includes a strip conductor 38 that is provided on the side opposite to the radiating conductor element 9 as viewed from the ground conductor plate 8. The strip conductor 38 can be made of a conductive metallic material similar to that of the ground conductor plate 8, for example, and is formed in the shape of a narrow strip extending in the X-axis direction. The strip conductor 38 is provided on the back side 32B of the multilayer substrate 32 (i.e., on the back side of the insulating layer 36).

An end of the strip conductor 38 is placed in the center portion of the connecting aperture 8A, and is connected to the radiating conductor element 9 via a via-hole 39 serving as a connecting line. The via-hole 39 is formed in substantially the same manner as the via-hole 14 according to the first embodiment. The via-hole 39 penetrates the insulating layers 35 and 36, and extends in the Z-axis direction through the center portion of the connecting aperture 8A. The ends of the via-hole 39 are respectively connected to the radiating conductor element 9 and the strip conductor 38.

The coupling adjusting conductor plate 40 can be formed in substantially the same manner as the coupling adjusting conductor plate 16 according to the first exemplary embodiment. The coupling adjusting conductor plate 40 is provided between the insulating layer 33 and the insulating layer 34, and is placed between the radiating conductor element 9 and the parasitic conductor element 15. The coupling adjusting conductor plate 40 partially covers, or overlaps the area where the radiating conductor element 9 and the parasitic conductor element 15 overlap each other, and straddles the radiating conductor element 9 in the Y-axis direction.

However, the coupling adjusting conductor plate 40 differs from the coupling adjusting conductor plate 16 according to the first exemplary embodiment in that the both end sides of the coupling adjusting conductor plate 40 are electrically connected to the ground conductor plate 8 by using via-holes 41 that penetrate the multilayer substrate 32. In this case, like the via-holes 17 according to the first exemplary embodiment, the via-holes 41 each form a columnar conductor. The via-holes 41 penetrate all of the insulating layers 33 to 36 of the multilayer substrate 32. Therefore, the via-holes 41 extend in the Z-axis direction, and are connected at some point along the Z-axis direction to each of the ground conductor plate 8 and the coupling adjusting conductor plate 16.

In this way, in this embodiment as well, an operational effect similar to that of the first exemplary embodiment can be obtained. In particular, in this embodiment, the coupling adjusting conductor plate 40 is connected to the ground conductor plate 8 by using the via-holes 41 that penetrate the multilayer substrate 32. Therefore, even in a case where it is difficult to form via-holes that provide connection between specific layers, the via-holes 41 formed by through via-holes can be easily formed.

While the above description of the third exemplary embodiment is directed to the case of an application to the wideband patch antenna 31 that includes the microstrip line 37 as in the second embodiment, embodiments according to the present disclosure may be applied to a wideband patch antenna that includes a strip line as in the first exemplary embodiment mentioned above.

Figure 15:
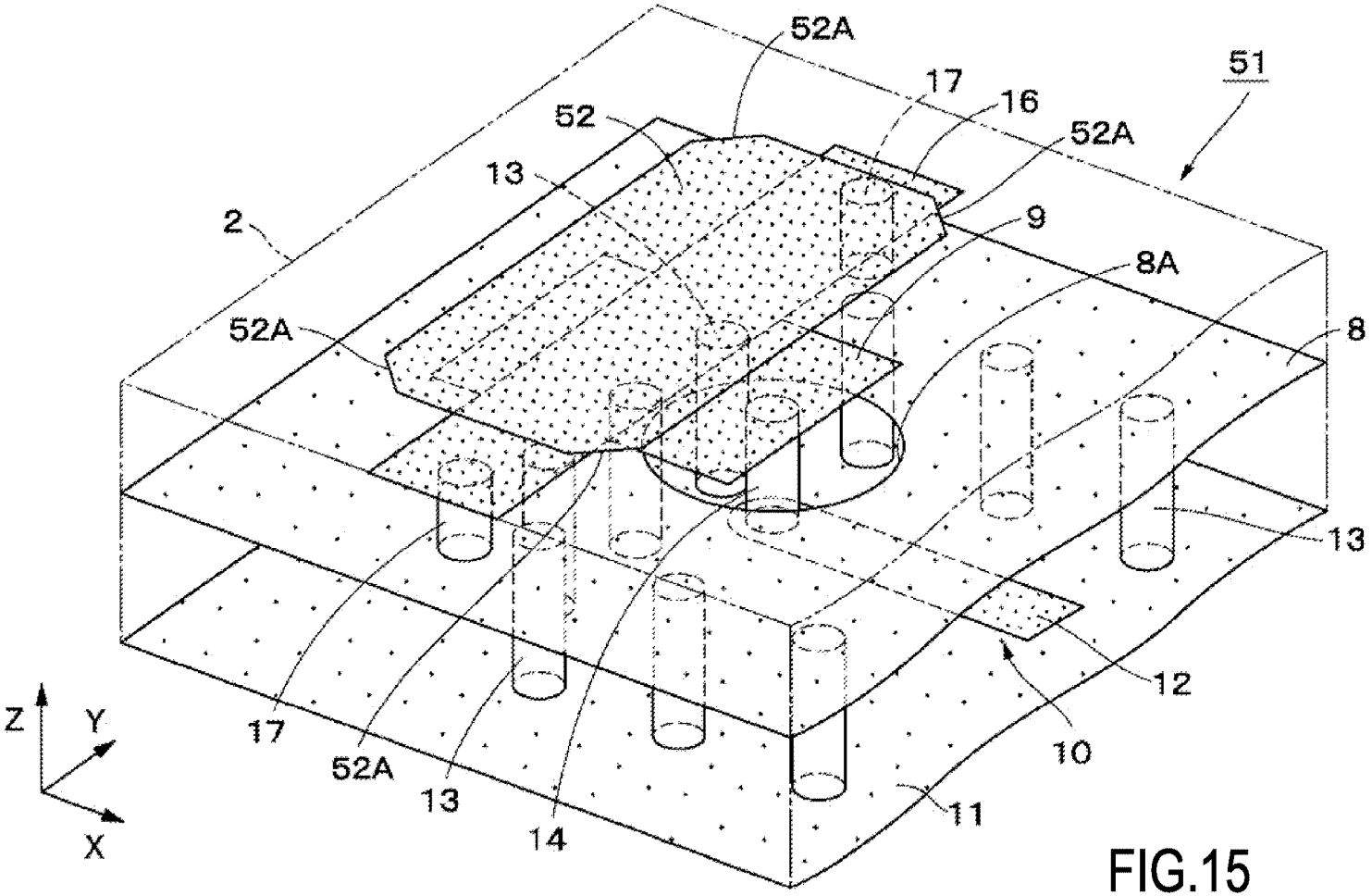
FIG. 15 is a perspective view illustrating a wideband patch antenna according to a fourth exemplary embodiment.
Figure 16:
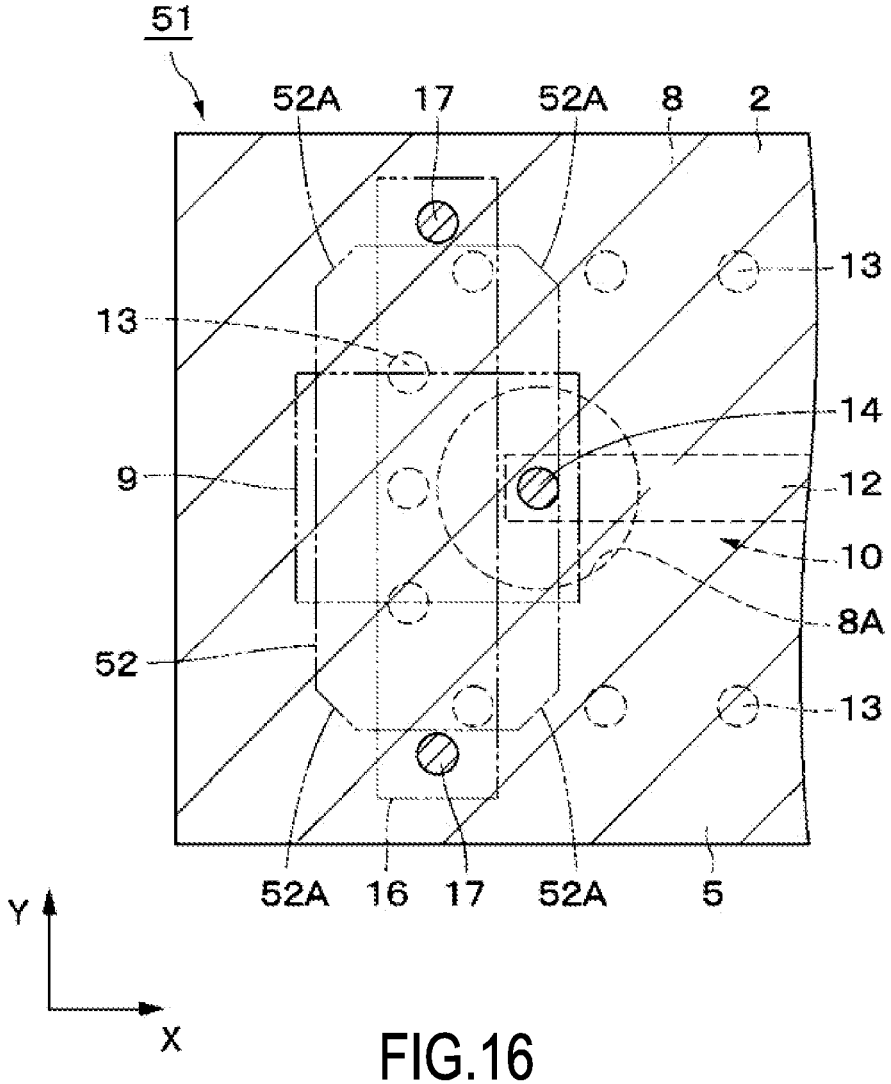
FIG. 16 is a cross-sectional view of the wideband patch antenna according to the fourth embodiment taken at a position similar to FIG. 4.

Next, FIGS. 15 and 16 illustrate a fourth exemplary embodiment. The characteristic feature of this embodiment resides in that the parasitic conductor element is formed by a substantially rectangular conductor plate that is cut off at the corner portion. In this embodiment, components that are identical to those of the first exemplary embodiment mentioned above are denoted by the identical symbols and are described above.

A wideband patch antenna 51 according to the fourth exemplary embodiment includes the multilayer substrate 2, the ground conductor plate 8, the radiating conductor element 9, a parasitic conductor element 52, the coupling adjusting conductor plate 16, and the like.

The parasitic conductor element 52 is formed in substantially the same manner as the parasitic conductor element 15 according to the first exemplary embodiment. However, the parasitic conductor element 52 according to this embodiment is formed by a substantially rectangular conductor plate having a cut-off part 52A where the corner portion of the parasitic conductor element 52 is cut off. While the cut-off part 52A of the parasitic conductor 52 is cut off linearly in the present case, the cut-off part 52A may be cut off in an arcuate shape, for example.

The path of the current flowing in the parasitic conductor element 52 varies with the shape of the cut-off part 52A. Therefore, the amount of coupling between the radiating conductor element 9 and the parasitic conductor element 52 can be adjusted by setting the shape of the cut-off part 52A as appropriate.

To investigate the effect of the cut-off part 52A, the frequency characteristics of return loss were measured for a case where the corner portion is cut off according to the fourth embodiment (4TH EMBODIMENT), and a fourth comparative example (4TH COMP. EXAMPLE) case where the corner portion is not cut off. The results are illustrated in FIG. 17.

Figure 17:
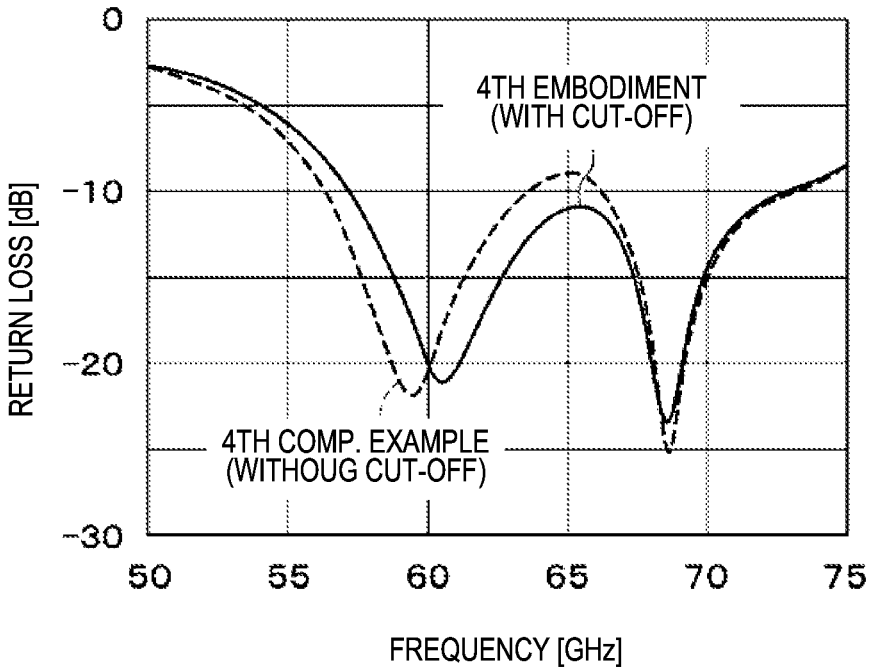
FIG. 17 is a characteristic diagram illustrating the frequency characteristics of return loss, for each of the fourth embodiment and a fourth comparative example.

The results in FIG. 17 show that in the case where the corner portion is not cut off, the return loss rises to about −8 dB in the frequency range between the two resonant frequencies. In contrast, in the case where the corner portion is cut off, as compared with the case where the corner portion is not cut off, although the resonant frequency on the low frequency side shifts to the high frequency side, the return loss drops below −10 dB in the frequency range between the two resonant frequencies. Therefore, the frequency bandwidth over which the return loss drops below −10 dB is about 15 GHz, indicating an increase in the corresponding bandwidth.

In this way, in this embodiment as well, an operational effect similar to that of the first exemplary embodiment can be obtained. In particular, in this embodiment, the parasitic conductor element 52 is formed by a substantially rectangular conductor plate having the cut-off part 52A where the corner portion of the parasitic conductor element 52 is cut off. Therefore, the amount of coupling between the parasitic conductor element 52 and the radiating conductor element 9 can be adjusted by adjusting the path of the current flowing in the parasitic conductor element 52, thereby lowering return loss. Therefore, the frequency range over which the strip line 10 and the radiating conductor element 9 are matched can be increased, thereby achieving bandwidth enhancement.

While the above description of the fourth exemplary embodiment is directed to the case of an application to the wideband patch antenna 51 similar to that of the first exemplary embodiment, embodiments according to the present disclosure may be applied to the wideband patch antenna 21, 31 according to the second or third exemplary embodiments.

While the above description of exemplary embodiments is directed to the case of the wideband patch antenna 1, 21, 31, 51 formed on the multilayer substrate 2, 22, 32, a wideband patch antenna may be formed by providing a single-layer substrate with a conductor plate and the like.

While the above description of exemplary embodiments is directed to the case of using the strip line 10 or the microstrip line 27, 37 as a feed line, for example, other kinds of feed lines such as a coaxial cable may be used.

While the above description of the embodiments is directed to the case of a wideband patch antenna used for millimeter waves in the 60 GHz band, embodiments according to the present disclosure may be applied to wideband patch antennas used for millimeter waves in other frequency ranges, microwaves, or the like.

According to embodiments of the present disclosure, the coupling adjusting conductor plate partially covers (i.e., overlaps) the area where the parasitic conductor element and the radiating conductor element overlap each other, and straddles the radiating conductor element in a direction orthogonal to the direction of the current that flows in the radiating conductor element. Therefore, when the radiating conductor element and the parasitic conductor element are electromagnetically coupled to each other, the strength of the electromagnetic coupling can be adjusted by using the coupling adjusting conductor plate, thereby increasing the frequency range over which matching is obtained between the feed line and the radiating conductor element.

Specifically, when the width direction of the coupling adjusting conductor plate is made parallel to the direction of the current that flows in the radiating conductor element, by adjusting the width dimension of the coupling adjusting conductor plate, the strength of the magnetic coupling between the radiating conductor element and the parasitic conductor element can be adjusted. Also, when the length direction of the coupling adjusting conductor plate is made orthogonal to the direction of the current that flows in the radiating conductor element, by adjusting the length dimension of the coupling adjusting conductor plate, the resonant frequency of current can be adjusted.

For example, in a case where the ground conductor plate and the coupling adjusting conductor plate are provided to a substrate made of an insulating material, the ground conductor plate and the coupling adjusting conductor plate can be easily connected to each other by using via-holes provided in the substrate. Therefore, soldered connections can be obviated to simplify assembly and increase productivity. Moreover, variations in characteristics among individual antennas can be reduced.

According to embodiments in which both end sides of the coupling adjusting conductor plate are connected to the ground conductor plate by using a columnar conductor, in a case where the ground conductor plate and the coupling adjusting conductor plate are provided to a substrate made of an insulating material, the ground conductor plate and the coupling adjusting conductor plate can be easily connected to each other by using a via-hole forming a columnar conductor which is provided in the substrate.

In embodiment in which the feed line includes a strip line, where the strip line has another ground conductor plate that is provided on a side opposite to the radiating conductor element as viewed from the ground conductor plate, a strip conductor is provided between the other ground conductor plate and the ground conductor plate, and the strip conductor of the strip line connects to the radiating conductor element via a connecting aperture that is provided in the ground conductor plate, in a case where the ground conductor plate, the radiating conductor element, and the coupling adjusting conductor plate are provided to a substrate made of an insulating material, the strip line can be formed in the substrate together with these components, thereby improving productivity and reducing variations in characteristics.

In embodiments in which the feed line includes a microstrip line, where the microstrip line has a strip conductor that is provided on a side opposite to the radiating conductor element as viewed from the ground conductor plate, and the strip conductor of the microstrip line connects to the radiating conductor element via a connecting aperture that is provided in the ground conductor plate, in a case where the ground conductor plate, the radiating conductor element, and the coupling adjusting conductor plate are provided to a substrate made of an insulating material, the microstrip line can be formed in the substrate together with these components, thereby improving productivity and reducing variations in characteristics.

In embodiments in which the parasitic conductor element includes a substantially rectangular conductor plate that is cut off at a corner portion, by adjusting the path of the current flowing in the parasitic conductor element, the amount of coupling between the parasitic conductor element and the radiating conductor element can be adjusted, thereby increasing the frequency range over which the feed line and the radiating conductor element are matched.

In embodiments in which the ground conductor plate, the radiating conductor element, the parasitic conductor element, and the coupling adjusting conductor plate are provided to a multilayer substrate having a plurality of laminated insulating layers, and are placed at positions different from each other with respect to a thickness direction of the multilayer substrate, by providing the ground conductor plate, the radiating conductor element, the parasitic conductor element, and the coupling adjusting conductor plate on the front sides of different insulating layers, these components can be easily placed at different positions with respect to the thickness direction of the multilayer substrate. As a result, productivity can be increased, and variations in characteristics among individual antennas can be reduced.

That which is claimed is:

1. A wideband antenna comprising:

a ground conductor plate configured to be connected to a ground potential;

a radiating conductor element facing the ground conductor plate at a distance from the ground conductor plate and connected to a feed line;

a parasitic conductor element on a side opposite to the ground conductor plate as viewed from the radiating conductor element, and insulated from the ground conductor plate and the radiating conductor element; and a coupling adjusting conductor plate positioned between the parasitic conductor element and the radiating conductor element, and configured to adjust an amount of coupling between the parasitic conductor element and the radiating conductor element, wherein the coupling adjusting conductor plate extends across an entire width of the radiating conductor element in a direction orthogonal to a direction of a current that flows in the radiating conductor element, the coupling adjusting conductor plate overlaps a center of an entire area where the parasitic conductor element and the radiating conductor element overlap each other, and both ends sides of the coupling adjusting conductor plate are electrically connected to the ground conductor plate.

2. The wideband antenna according to claim 1, wherein the both end sides of the coupling adjusting conductor plate are connected to the ground conductor plate by using a columnar conductor.

3. The wideband antenna according to claim 1, wherein:

the feed line includes a strip line, the strip line having:

another ground conductor plate that is provided on a side opposite to the radiating conductor element as viewed from the ground conductor plate, and a strip conductor that is provided between the other ground conductor plate and the ground conductor plate and connecting to the radiating conductor element via a connecting aperture provided in the ground conductor plate.

4. The wideband antenna according to claim 1, wherein:

the feed line includes a microstrip line, the microstrip line having a strip conductor that is provided on a side opposite to the radiating conductor element as viewed from the ground conductor plate, and the strip conductor of the micro strip line connects to the radiating conductor element via a connecting aperture provided in the ground conductor plate.

5. The wideband antenna according to claim 1, wherein the parasitic conductor element includes a substantially rectangular conductor plate that is cut off at a corner portion.

6. The wideband antenna according to claim 1, wherein the ground conductor plate, the radiating conductor element, the parasitic conductor element, and the coupling adjusting conductor plate are provided to a multilayer substrate having a plurality of laminated insulating layers, and are placed at positions different from each other with respect to a thickness direction of the multilayer substrate.

7. The wideband antenna according to claim 1, wherein a width of the coupling adjusting conductor plate in the orthogonal direction is greater than a width of the radiating conductor element in the direction orthogonal to the direction of the current that flows through the radiating conductor element.

8. The wideband antenna according to claim 1, wherein a length of the coupling adjusting conductor plate in the direction of the current is less than the length of the of the radiating conductor element in the direction of the current.

9. The wideband antenna according to claim 8, wherein the length of the coupling adjusting conductor plate is within the range of 30-80% of the length of the radiating conductor element.

* * * * *